US010151471B2

(12) United States Patent
Hulet et al.

(10) Patent No.: US 10,151,471 B2
(45) Date of Patent: Dec. 11, 2018

(54) LIGHTED LADDER

(71) Applicant: RED DIRT INNOVATIONS, LLC, Perry, OK (US)

(72) Inventors: Timothy Wayne Hulet, Perry, OK (US); Donnie Lee Williamson, Newkirk, OK (US)

( * ) Notice: Subject to any disclaimer, the term of this patent is extended or adjusted under 35 U.S.C. 154(b) by 0 days.

(21) Appl. No.: 15/606,033

(22) Filed: May 26, 2017

(65) Prior Publication Data

US 2017/0350584 A1 Dec. 7, 2017

Related U.S. Application Data

(60) Provisional application No. 62/345,248, filed on Jun. 3, 2016.

(51) Int. Cl.
*F21V 33/00* (2006.01)
*E06C 7/00* (2006.01)
(Continued)

(52) U.S. Cl.
CPC ..... *F21V 33/0004* (2013.01); *E06C 7/00* (2013.01); *E06C 9/14* (2013.01); *F21L 4/02* (2013.01);
(Continued)

(58) Field of Classification Search
CPC .. F21S 4/003; E06C 7/00; E06C 7/003; E06C 7/14; E06C 7/08; E06C 5/00; A62B 35/04
See application file for complete search history.

(56) References Cited

U.S. PATENT DOCUMENTS 145,209 A * 12/1873 Hyatt ..... E04B 5/46 404/22
2,479,500 A * 8/1949 Longberg ..... F21V 33/006 362/146
(Continued)

FOREIGN PATENT DOCUMENTS

CN 202300162 A1 7/2012
CN 104863493 A1 8/2015
(Continued)

OTHER PUBLICATIONS

How to "bling" Up a Boring Staircase. available at http://www.instructables.com/id/How-to-bling-up-a-boring-staircase, last visited on Sep. 21, 2017.
(Continued)

*Primary Examiner* — Katherine W Mitchell
*Assistant Examiner* — Candace L Bradford
(74) *Attorney, Agent, or Firm* — Martin S. High, P.C.

(57) ABSTRACT

Embodiments of the Lighted Ladder are comprised of a ladder; a plastic housing; one or more LED strip lighting; a cordless battery mounting means; a battery; a controller housing; a control interface; power wiring; potentiometer wiring; and motion sensor wiring. The ladder is weight-balanced by placement of the battery mounting means, the battery, and controller housing in a low position on the ladder. The battery mounting means is designed to accept a cordless tool battery. The battery mounting means is designed to accept a commercially available battery of at least 12V and at least 3.0 Ah. One plastic housing is located on each of the vertical front rails. Each LED strip lighting can illuminate an angular range of 120 degrees (120°) creating a total illumination range of 300 degrees (300°).

11 Claims, 7 Drawing Sheets

(51) Int. Cl.

| | |
|---|---|
| ***F21L 4/02*** | (2006.01) |
| ***F21V 15/01*** | (2006.01) |
| ***F21V 23/00*** | (2015.01) |
| ***F21V 23/04*** | (2006.01) |
| ***E06C 9/14*** | (2006.01) |
| *F21Y 103/10* | (2016.01) |
| *F21Y 115/10* | (2016.01) |
| *F21W 131/10* | (2006.01) |
| *E06C 1/16* | (2006.01) |

(52) U.S. Cl.

CPC ..... *F21V 15/01* (2013.01); *F21V 23/001* (2013.01); *F21V 23/007* (2013.01); *F21V 23/0471* (2013.01); *E06C 1/16* (2013.01); *F21W 2131/1005* (2013.01); *F21Y 2103/10* (2016.08); *F21Y 2115/10* (2016.08)

(56) References Cited

U.S. PATENT DOCUMENTS

| | | | | |
|---|---|---|---|---|
| 4,311,208 | A * | 1/1982 | Macrorie | E06C 7/003 182/129 |
| 5,151,679 | A * | 9/1992 | Dimmick | G02B 6/0021 340/326 |
| 6,966,403 | B1 * | 11/2005 | Chandra | E06C 7/003 182/129 |
| 7,174,994 | B1 * | 2/2007 | Coffield | E06C 1/39 182/129 |
| 7,258,461 | B1 * | 8/2007 | Izardel | E01F 13/04 362/152 |
| 7,370,725 | B1 * | 5/2008 | Dornfeld | E06C 7/081 182/102 |
| 8,770,778 | B2 | 7/2014 | Pereira et al. | |
| 2001/0047905 | A1 | 12/2001 | Boyer | |
| 2011/0187275 | A1 | 8/2011 | Giltaca et al. | |
| 2012/0062133 | A1 | 3/2012 | Cubias | |
| 2013/0128557 | A1 | 5/2013 | Pereira et al. | |
| 2014/0299412 | A1 * | 10/2014 | Cordani | E06C 7/00 182/51 |
| 2014/0353081 | A1 * | 12/2014 | Linch | E06C 7/003 182/18 |
| 2015/0075908 | A1 * | 3/2015 | Moss | E06C 1/12 182/207 |
| 2015/0273255 | A1 * | 10/2015 | Lenz, Jr. | E06C 5/04 280/4 |
| 2015/0285476 | A1 | 10/2015 | Bruce et al. | |
| 2017/0167679 | A1 * | 6/2017 | Yui | G02B 5/0215 |

FOREIGN PATENT DOCUMENTS

| | | | |
|---|---|---|---|
| CN | 204730035 | A1 | 10/2015 |
| CN | 105041183 | A1 | 11/2015 |
| CN | 204920757 | A1 | 12/2015 |
| JP | 5207560 | A1 | 6/2013 |
| WO | WO2014075689 | A1 | 5/2014 |

OTHER PUBLICATIONS

Notification of Transmittal of the International Search Report and the Written Opinion of the International Searching Authority, or the Declaration, PCT/US 17/34769, transmitted on Aug. 24, 2017.

* cited by examiner

LIGHTED LADDER

STATEMENT REGARDING FEDERALLY SPONSORED RESEARCH OR DEVELOPMENT

Not applicable

BACKGROUND OF THE EMBODIMENTS

Field of the Embodiments

The general field of the embodiments of the Lighted Ladder is ladders. More specifically, the field comprises a lighting means integral to a ladder to illuminate the work area on which the ladder is being used.

Description of Prior Art

The prior art related to the embodiments of the Lighted Ladder are typically lighting means separate from a ladder. In typical use, work lights are used to illuminate the area of interest where the ladder is placed. This obviously requires a separate light from the ladder. The illumination provided by the separate light does not necessarily illuminate the area directly under the ladder. For a separate corded light, an electrical receptacle is required for the light.

SUMMARY OF THE EMBODIMENTS

Embodiments of the Lighted Ladder are comprised of a ladder; a plastic housing; one or more LED strip lighting; a cordless battery mounting means; a battery; a controller housing; a control interface; power wiring; potentiometer wiring; and motion sensor wiring. The ladder is weight-balanced by placement of the battery mounting means, the battery, and controller housing in a low position on the ladder. The battery mounting means is designed to accept a cordless tool battery. The battery mounting means is designed to accept a commercially available battery of at least 12V and at least 3.0 Ah. The controller housing is comprised of the dimmer controller and a motion activation controller that are located within the controller housing. Power wiring, motion sensor wiring, and potentiometer wiring is routed from the cordless battery mounting means and controller housing through the vertical rear rails to the control interface and then through the vertical front rails to the LED strip lighting. The ladder is comprised of two vertical front rails that accept a plurality of plastic housings. One plastic housing is located on each of the vertical front rails. Each LED strip lighting can illuminate an angular range of 120 degrees (120°) creating a total illumination range of 300 degrees (300°). The control interface is comprised of a dimmer potentiometer, a motion detect-power saving override switch, a side LED strip light switch that is used to select the side LED lights, a motion detector sensor, and a front LED strip light switch that is used to select the front LED lights.

In this respect, before explaining at least one embodiment of the embodiments in detail, it is to be understood that the embodiments are not limited in this application to the details of construction and to the arrangements of the components set forth in the following description or illustrated in the drawings. The embodiment or embodiments are capable of being practiced and carried out in various ways. Also, it is to be understood that the phraseology and terminology employed herein are for description and should not be regarded as limiting. As such, those skilled in the art will appreciate that the conception, upon which this disclosure is based, may readily be used as a basis for the designing of other structures, methods and systems for carrying out the several purposes of the embodiments. Additional benefits and advantages of the embodiments will become apparent in those skilled in the art to which the present embodiments relate from the subsequent description of the preferred embodiment and the appended claims, taken in conjunction with the accompanying drawings. It is important, therefore, that the claims be regarded as including such equivalent constructions insofar as they do not depart from the spirit and scope of the embodiments.

Further, the purpose of the foregoing abstract is to enable relevant patent granting authorities and the public generally, and especially the scientist, engineers and practitioners in the art who are not familiar with patent or legal terms or phraseology, to determine quickly from a cursory inspection the nature and essence of the technical disclosure of the application. The abstract is neither intended to define the embodiments of the application which is measured by the claims, nor is it intended to be limiting as to the scope of the embodiments in any way.

DETAILED DESCRIPTION OF THE PREFERRED EMBODIMENTS

Figure 1:
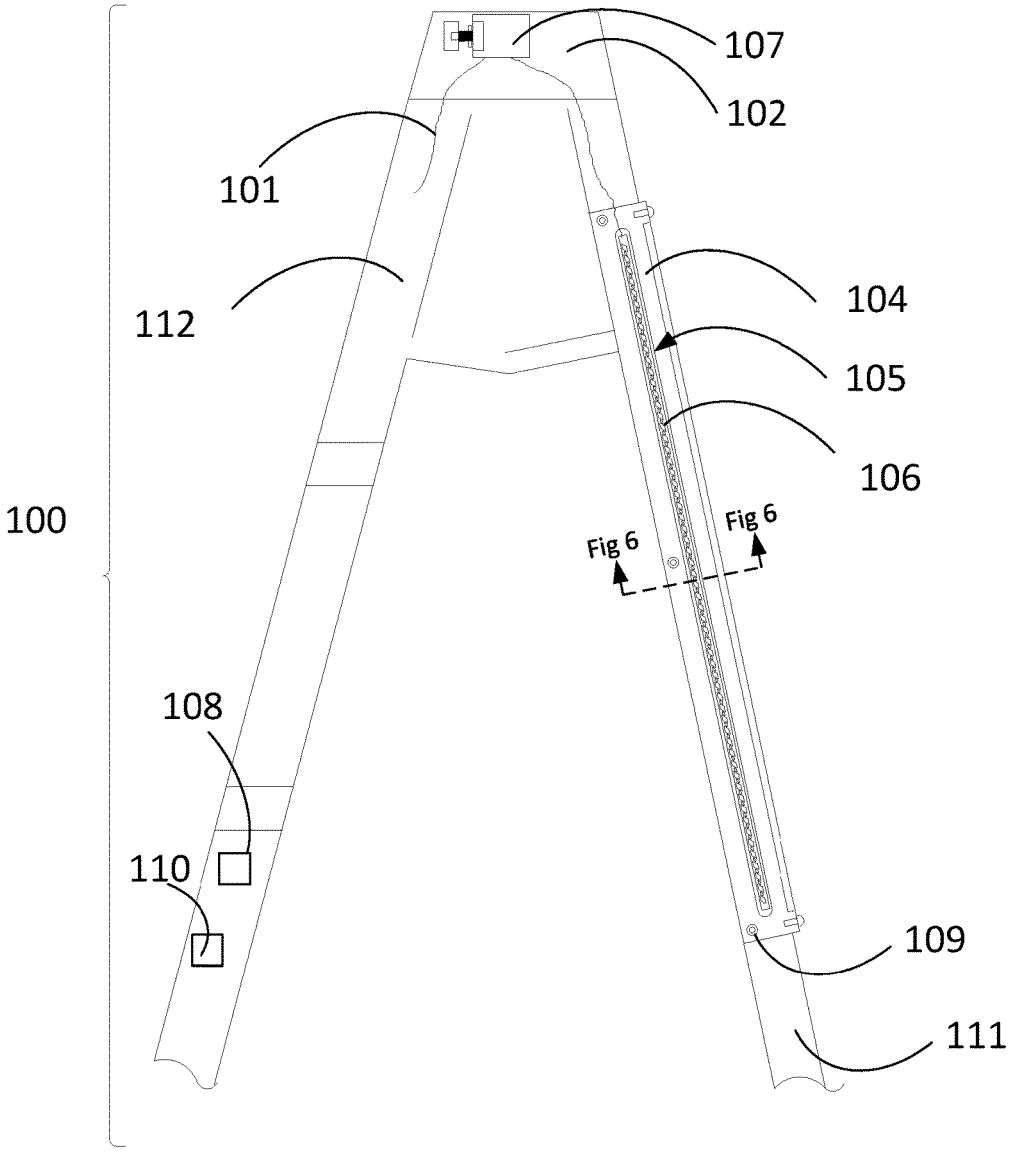
FIG. 1 is a side view of an embodiment of the Lighted Ladder 100.
Figure 2:
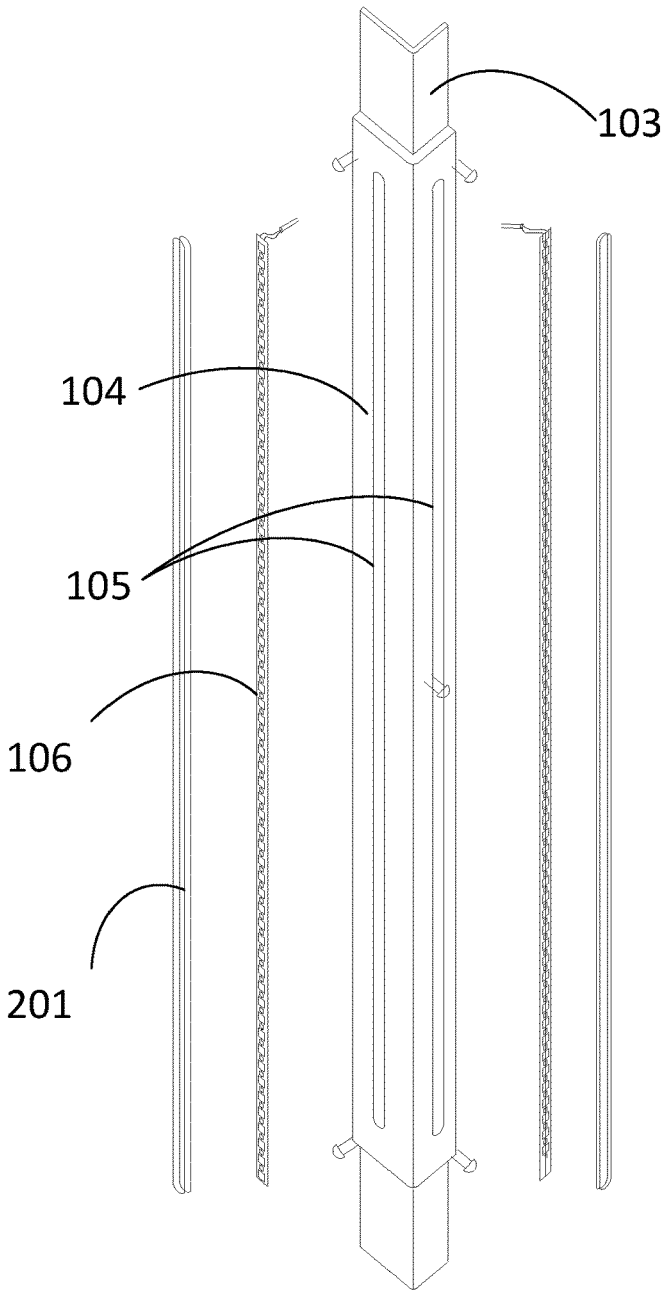
FIG. 2 is an exploded view of an embodiment of the Lighted Ladder 100 showing the assembly of the LED lights.
Figure 3:
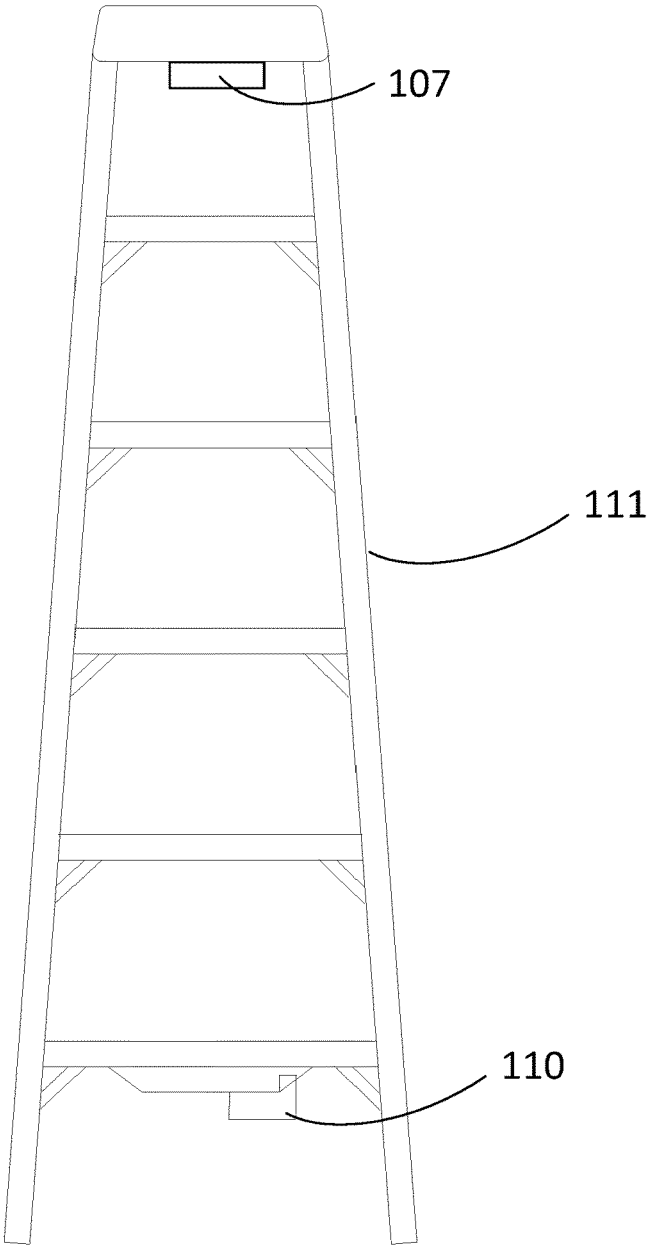
FIG. 3 is a back view of an embodiment of the Lighted Ladder 100.
Figure 4:
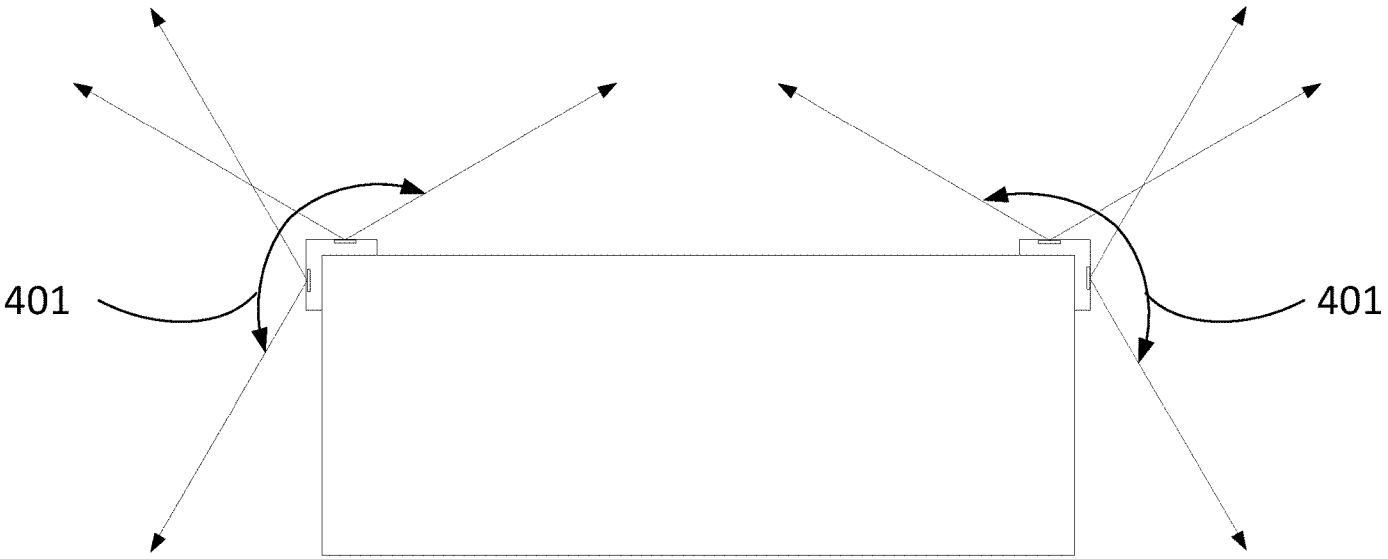
FIG. 4 is a schematic showing the arc of light generated by the assembly of the LED lights on an embodiment of the Lighted Ladder 100.
Figure 5:
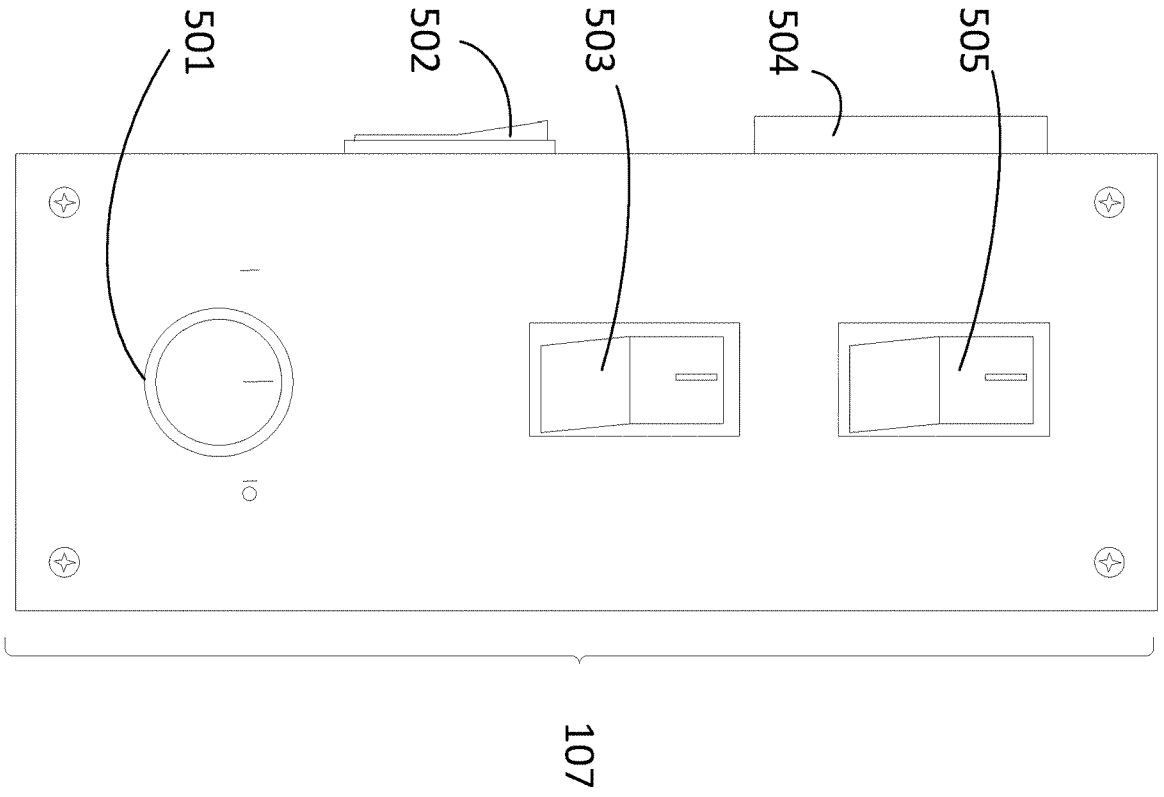
FIG. 5 is a front view of an embodiment of the control interface 107 showing the various components of the control interface 107.
Figure 6:
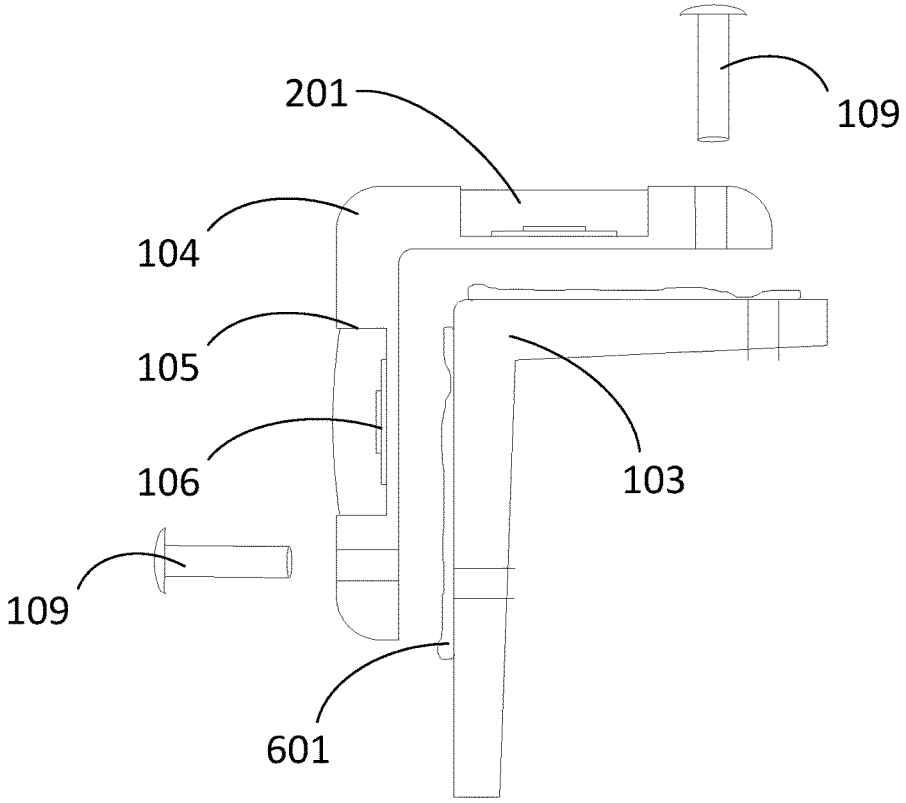
FIG. 6 is a sectional view of an embodiment of the Lighted Ladder 100.
Figure 7:
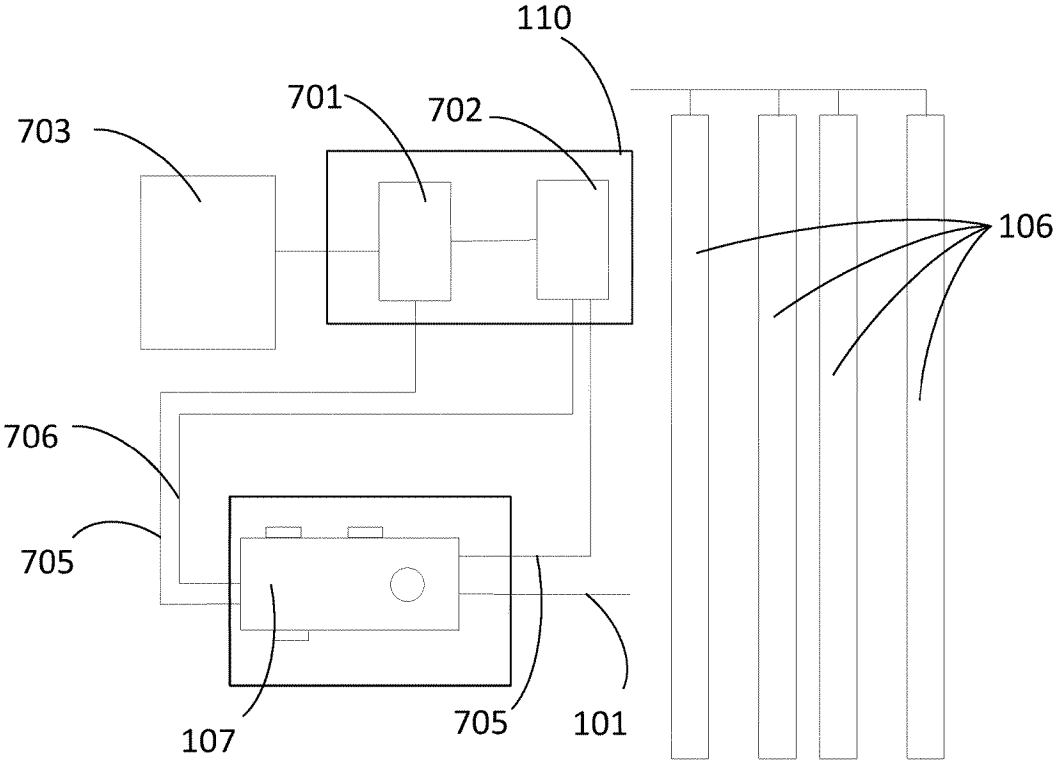
FIG. 7 is a schematic view of an embodiment of the electrical connections made in the Lighted Ladder.

Embodiments of the Lighted Ladder 100 are comprised of a ladder 111; a plastic housing 104; one or more LED strip lighting 106; a cordless battery mounting means 108; a battery 703; a controller housing 110; a control interface 107; power wiring 101; potentiometer wiring 706; and motion sensor wiring 705.

The ladder 111 is weight-balanced by placement of the battery mounting means 108, the battery 703, and controller housing 110 in a low position on the ladder 111. In one embodiment, the battery mounting means 108, the battery 703, and controller housing 110 are located under the first step to maintain a low center of gravity for the overall Lighted Ladder 100 and to avoid interference with the use of the ladder.

The battery mounting means 108 is designed to accept a cordless tool battery. The battery mounting means 108 is designed to accept a commercially available battery 703 of at least 12V and at least 3.0 Ah. The battery mounting means 108 is located under the bottom step of the ladder to reduce the center of gravity of the overall Lighted Ladder 100. The battery 703 is connected via the cordless battery mounting means 108 via power wiring 101 to the other components of the Lighted Ladder 100 including the LED strip lighting 106.

The controller housing 110 is comprised of the dimmer controller 702 and a motion activation controller 701 that are located within the controller housing 110. The dimmer controller 702 is comprised of a DC pulse width modulated dimmer. The motion activation controller 701 is comprised of a motion detection logic controller. The control interface 107 is also comprised of switches, a dimmer potentiometer 501, a motion sensor 504, and a motion detection on/off switch 502. In one embodiment of the Light Ladder 100 the controller housing 110 is mounted with the battery mounting means 108 under the bottom step.

Power wiring 101, motion sensor wiring 705, and potentiometer wiring 706 is routed from the cordless battery mounting means 108 and controller housing 110 through the vertical rear rails 112 to the control interface 107 and then through the vertical front rails 103 to the LED strip lighting 106.

The ladder 111 is comprised of two vertical front rails 103 that accept a plurality of plastic housings 104. One plastic housing 104 is located on each of the vertical front rails 103. The plastic housings 104 form channels 105 to accept one or more LED strip lighting 106. The LED strip lighting 106 is housed within one or more channels 105 formed by the plastic housing 104. The plastic housing 104 is mounted on the front rails 103 such that two LED strip lighting 106 are oriented 90 degree from each other within the channel on the plastic housing 104 in a general forward and side facing direction. A clear acrylic epoxy resin is poured and injected around the LED strip light 106 is to create a weather and shock proof epoxy lens 201 which forms over the LED strip lighting 106 in the channels 105. Each plastic housing 104 also provides additional stiffness to the ladder structure. The plurality of plastic housings 104 are mounted to each side of the front rails of the ladder using rivets 109, adhesive 601, or both rivets 109 and adhesive 601.

Each LED strip lighting 106 can illuminate an angular range 401 of 120 degrees (120°) creating a total illumination range of 300 degrees (300°). In one embodiment, the LED strip lighting illuminates an angular range of 160 degrees (160°). The wiring to the switching and a dimmer potentiometer 501 located under top cap 102 or vertical front rails 103 of the ladder 111 is routed to the front and side lights via one of the channels 105 and concealed by the epoxy lens 201.

The LED strip lighting 106 produces 881.0 lumens per foot of strip lighting. The complete set of LED strip lighting 106 then produces 7040.0 lumens of light for a typically sized ladder. This illumination amount is the equivalent of approximately four 100 watt incandescent lightbulbs.

The LED strip lighting 106 produces light with a CRI index rating of 80. As a comparison, sunlight is CRI 100 therefore, the LED strip lighting 106 produces high quality and amounts of light for painters, plumbers, electricians and all who require high quality lighting.

The dimmer controller 702 is comprised of a pulse width modulated driver circuit located under the first step and controlled by a remote a dimmer potentiometer 501. The dimmer potentiometer 501 is mounted inside the control interface 107 and is connected via a potentiometer wire 706. In one embodiment, the control interface is mounted under top cap 102 of the ladder 111 to avoid damage and to keep it out of weather should it be left outside or on the vertical front rails 103.

The control interface 107 is comprised of a dimmer potentiometer 501, a motion detect-power saving override switch 502, a side LED strip light switch 503 that is used to select the side LED lights, a motion detector sensor 504, and a front LED strip light switch 505 that is used to select the front LED lights.

The motion activation controller 701 is located within the controller housing 110 mounted under the first step. The motion control sensor 504 is mounted on the control interface 107 and is connected to the motion controller 701 via motion sensor wiring 705. The motion detection function is modal and can be selected by the override switch 502 on the control interface 107. The function of the motion detector is to allow energy savings of the battery when there is no movement around the ladder for a pre-determined amount of time. The elapsed time to shut-off can be adjusted using the motion controller 701.

What is claimed is:

1. A lighted ladder comprising a ladder; a top cap; one or more plastic housings; one or more LED strip lights; a cordless tool battery mounting means; a cordless tool battery of at least 12 V and 2 Ah; a controller housing; a control interface; power wiring; motion detection control wiring; wherein the lighted ladder is weight-balanced by placement of the cordless tool battery mounting means with the cordless tool battery in a low position on the ladder relative to the controller housing and the control interface; wherein the controller housing is comprised of a dimmer controller and a motion activation controller located within the controller housing; wherein the power wiring, motion sensor wiring, and potentiometer wiring is routed from the cordless tool battery mounting means and the controller housing through vertical rear rails; wherein the dimmer controller is comprised of a DC pulse width modulated dimmer; and wherein the motion activation controller is comprised of a motion detection logic controller.

2. The lighted ladder in claim 1 wherein the control interface is comprised of switches, dimmer potentiometer, and a motion sensor and a motion detection on-off switch.

3. The lighted ladder in claim 1 wherein the control interface is mounted either under the top cap of the ladder or on a vertical front rail of the ladder.

4. The lighted ladder in claim 1 wherein the ladder is comprised of two vertical front rails that each accept the one or more plastic housings; wherein each plastic housing is located on a respective one of the vertical front rails; wherein each plastic housing form channels; wherein each channel accepts the one or more LED strip lights.

5. The lighted ladder in claim 4 wherein the plastic housing is mounted on the front rails such that two LED strip lights are oriented 90 degree from each other on the plastic housing in a general forward and side facing direction.

6. The lighted ladder in claim 5 wherein a clear acrylic epoxy resin is poured and injected around the LED strip lights.

7. The lighted ladder in claim 6 wherein each LED strip lights illuminate an angular range of 120 degrees (120°) creating a total illumination range of 300 degrees (300°).

8. The lighted ladder in claim 6 wherein each LED strip lights illuminates an angular range of 160 degrees (160°).

9. The lighted ladder in claim 1 wherein the control interface is comprised of a side LED strip light switch; and an electronic front LED strip light switch; wherein the dimmer controller is located in the controller housing and controlled by a remote potentiometer mounted inside the control interface and connected via a potentiometer wire.

10. The lighted ladder in claim 9 comprising two or more side LED strip lights; one or more front LED strip lights; and a motion detector sensor; wherein the control interface is comprised of a dimmer switch and a motion detect-power saving override switch; wherein the one or more LED strip lights are comprised of one or more side LED strip lights and one or more front LED strip lights; wherein the side LED strip light switch is used to select the side LED strip lights; and wherein the front LED strip light switch that is used to select the front LED strip lights.

11. The lighted ladder of claim 1 comprising wherein the one or more LED strip lights are capable of generating a minimum of 881 lumens of continuous light; wherein the cordless tool battery generates a minimum of 12 VDC with a minimum capacity of 2.0 Ah; wherein the DC pulse width modulated dimmer is connected to a user adjustable dimmer potentiometer and an on-off feature; and wherein the user adjustable dimmer potentiometer and on-off feature are located inside the control interface.

* * * * *